US006425495B1

(12) United States Patent
Senda et al.

(10) Patent No.: US 6,425,495 B1
(45) Date of Patent: Jul. 30, 2002

(54) ARTICLE DISPENSING APPARATUS

(75) Inventors: Junji Senda; Yoshimi Miyamoto, both of Tokyo (JP)

(73) Assignee: Kabushiki Kaisha Bandai, Tokyo (JP)

( * ) Notice: Subject to any disclaimer, the term of this patent is extended or adjusted under 35 U.S.C. 154(b) by 0 days.

(21) Appl. No.: 10/007,544

(22) Filed: Nov. 6, 2001

Related U.S. Application Data

(63) Continuation of application No. 09/431,651, filed on Nov. 1, 1996, now abandoned.

(30) Foreign Application Priority Data

Nov. 30, 1998 (JP) ..... 10-339326

(51) Int. Cl.[7] ..... B65G 59/02

(52) U.S. Cl. ..... 221/24; 221/210; 221/220; 221/226; 221/255

(58) Field of Search ..... 221/24, 210, 220, 221/226, 229, 255, 256, 279

(56) References Cited

U.S. PATENT DOCUMENTS

| | | | | |
|---|---|---|---|---|
| 1,186,530 A | * | 6/1916 | Dobrowsky | 221/220 |
| 1,291,231 A | * | 1/1919 | Stokkan | 221/210 |
| 2,705,576 A | * | 4/1955 | Amelio et al. | 221/256 |
| 3,622,041 A | * | 11/1971 | Borsam et al. | 221/220 |
| 3,844,445 A | | 10/1974 | Haas | |
| 4,295,579 A | | 10/1981 | Haas | |
| 4,311,251 A | * | 1/1982 | Sternberg | 221/229 |
| 4,589,575 A | | 5/1986 | Rigberg et al. | |
| 4,958,746 A | | 9/1990 | Wu | |
| 4,966,305 A | * | 10/1990 | Hinterreiter | 221/229 |
| 4,986,442 A | | 1/1991 | Hinterraiter | |
| 4,998,644 A | | 3/1991 | Pan | |
| 5,048,720 A | | 9/1991 | Hoke | |
| 5,071,033 A | * | 12/1991 | Siwek | 221/229 |
| 5,080,258 A | | 1/1992 | Hinterreiter | |
| 5,366,112 A | | 11/1994 | Hinterreiter | |
| 5,460,295 A | | 10/1995 | Law | |
| 5,603,429 A | | 2/1997 | Mulhauser et al. | |
| 5,785,206 A | | 7/1998 | Chan | |
| 5,791,514 A | | 8/1998 | Kirk, III et al. | |

FOREIGN PATENT DOCUMENTS

GB 525177 * 8/1940 ..... 221/220

OTHER PUBLICATIONS

US 5,178,296, 01/1993, Allina (withdrawn)

* cited by examiner

*Primary Examiner*—H. Grant Skaggs
(74) *Attorney, Agent, or Firm*—Luce, Forward, Hamilton & Scripps LLP

(57) ABSTRACT

An article dispensing apparatus with a novel structure is provided for lifting and taking out articles such as candies, stored in a stack within a case body, one by one from the top one. The article dispensing apparatus has a case body for storing articles in a stack. A dispensing opening that can take out the stored articles one by one from the top one is formed in the upper part of the case body, and an elastic member for biasing the stored articles toward the dispensing opening is provided in the lower part of the case body. A pair of engaging members are provided in the vicinity of the dispensing opening of the case body for engaging the both sides of the top article among a plurality of articles biased by the elastic member to prevent the plurality of articles from being dispensed from the dispensing opening. A rotating body is rotatably provided in the upper part of the case body, and a pair of holding pieces are provided in the rotating body for holding the both sides of the. top article among a plurality of articles while releasing the engagement of the pair of engaging members.

29 Claims, 7 Drawing Sheets

ARTICLE DISPENSING APPARATUS

This application is a continuation of Ser. No. 09/431,651 filed Nov. 1, 1999 and now abandoned.

BACKGROUND OF THE INVENTION

1. Field of the Invention

This invention relates to an article dispensing apparatus for taking out articles such as candies, which are stored in a stack in a case body, in an order from the top one.

2. Description of the Related Art

There is known a conventional article dispensing apparatus for taking out articles in an order from the top one in a stack stored in a case body such as the one disclosed in the Japanese Patent Laid-Open No. Hei 6-92379. An article dispensing apparatus disclosed in that application has a case body for storing flat articles such as chewing gum stacked in the vertical direction and is provided in the upper part of the case body with a dispensing device for pushing the stored articles one by one in an order from the top one so that the articles can be taken out. A sliding member is provided in the dispensing device for engaging the top article among a plurality of articles biased by an elastic member and making the article protrude from a front opening.

The conventional article dispensing apparatus as described above has a problem in that it simply slides the top article and cannot separate an article one by one from other articles to dispense it. The apparatus is made so that articles stored in a stack within the case body can be pushed by the sliding member of the apparatus and taken out one by one from the top one.

SUMMARY OF THE INVENTION

The present invention has been devised in view of the above drawbacks and it is an object of the present invention to provide an article dispensing apparatus with a novel structure, which can lift an article, such as a candy stored in a stack within a case body, one by one from the top one and dispense it.

In order to attain the above and other objects, an article dispensing apparatus in accordance with the first aspect of the present invention comprises:

(a) a case body for storing articles in a vertical stack;

(b) a dispensing opening formed in the upper part of the case body for taking out the stored articles one by one in an order from the top one, and an elastic member provided in the lower part of the case body for biasing the stored articles to the dispensing opening;

(c) a pair of engaging members provided in the vicinity of the dispensing opening of the case body for engaging both sides of the top article among a plurality of articles biased by the elastic member to prevent the plurality of articles from jumping out from the dispensing opening; and (d) a rotating body rotatably provided in the upper part of the case body, and a pair of holding pieces provided in the rotating body for holding the both sides of the top article among the plurality of articles while releasing the engagement of the pair of engaging members.

DESCRIPTION OF THE PREFERRED EMBODIMENT

Figure 1:
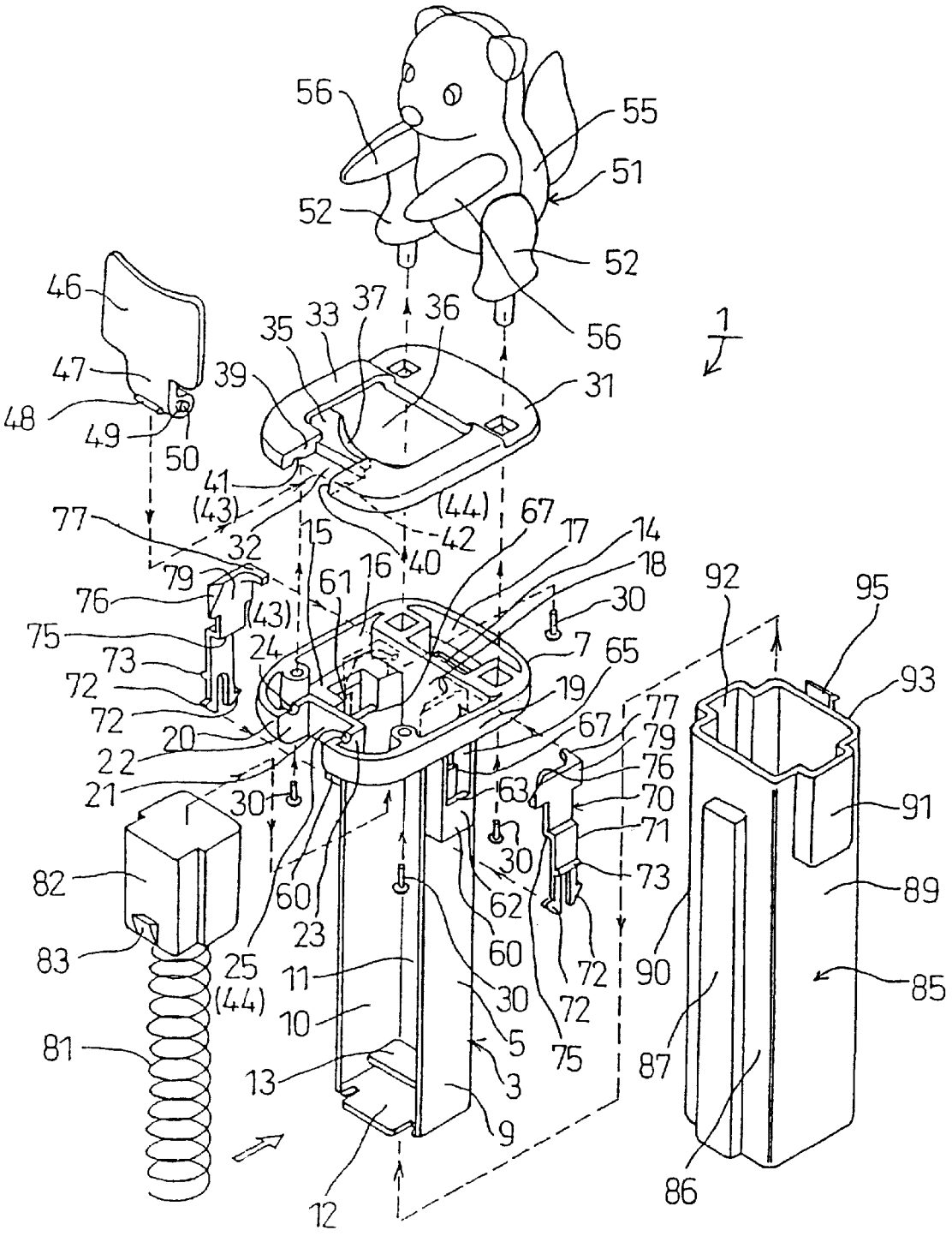
FIG. 1 is an overall perspective view of an article dispensing apparatus in accordance with the present invention.

An article dispensing apparatus embodying the present invention is now described based on FIG. 1 through FIG. 7. An article dispensing apparatus 1 in accordance with the first aspect of the present invention comprises a case body 4 for storing articles 2 in a vertical stack. A dispensing opening 36 is formed in the upper part of the case body 4, through which the stored articles 2 can be taken out one by one in an order from the top one, and an elastic member 81 is provided in the lower part of the case body 4 for biasing the stored articles 2 toward the dispensing opening 36.

A pair of engaging members 70 and 70 are provided in the vicinity of the dispensing opening 36 of the case body 4 for engaging both sides of the top article 2 among a plurality of articles 2 biased by the elastic member 81 and for preventing the plurality of articles 2 from jumping out from the dispensing opening 36. A rotating body 55 is rotatably provided in the upper part of the case body 4, and a pair of holding pieces 56 and 56 are provided in the rotating body 55 for holding both sides of the top article 2 among the plurality of articles 2 while releasing the engagement of the pair of engaging members 70 and 70.

Figure 4:
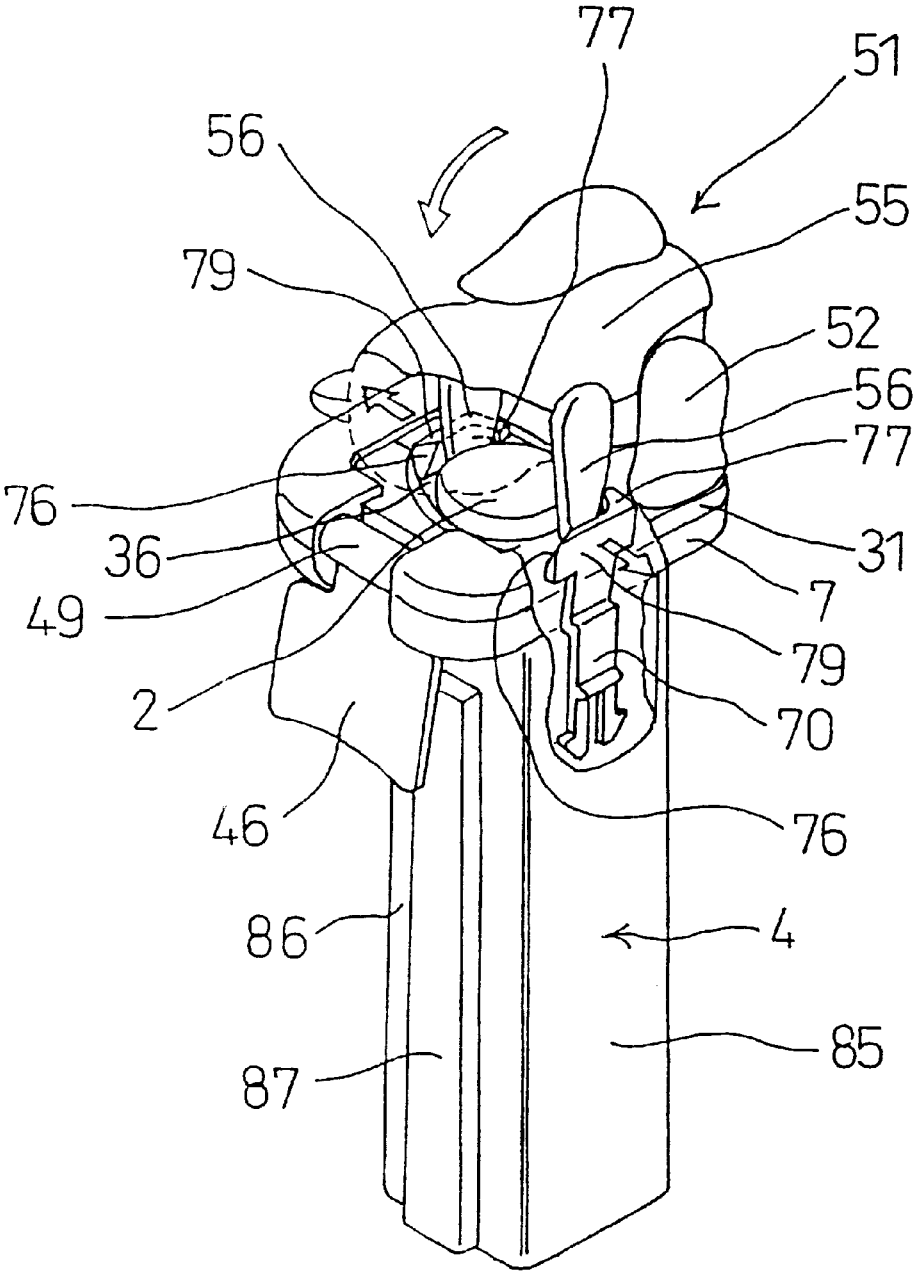
FIG. 4 is a perspective view showing the state in which an article is held.
Figure 5:
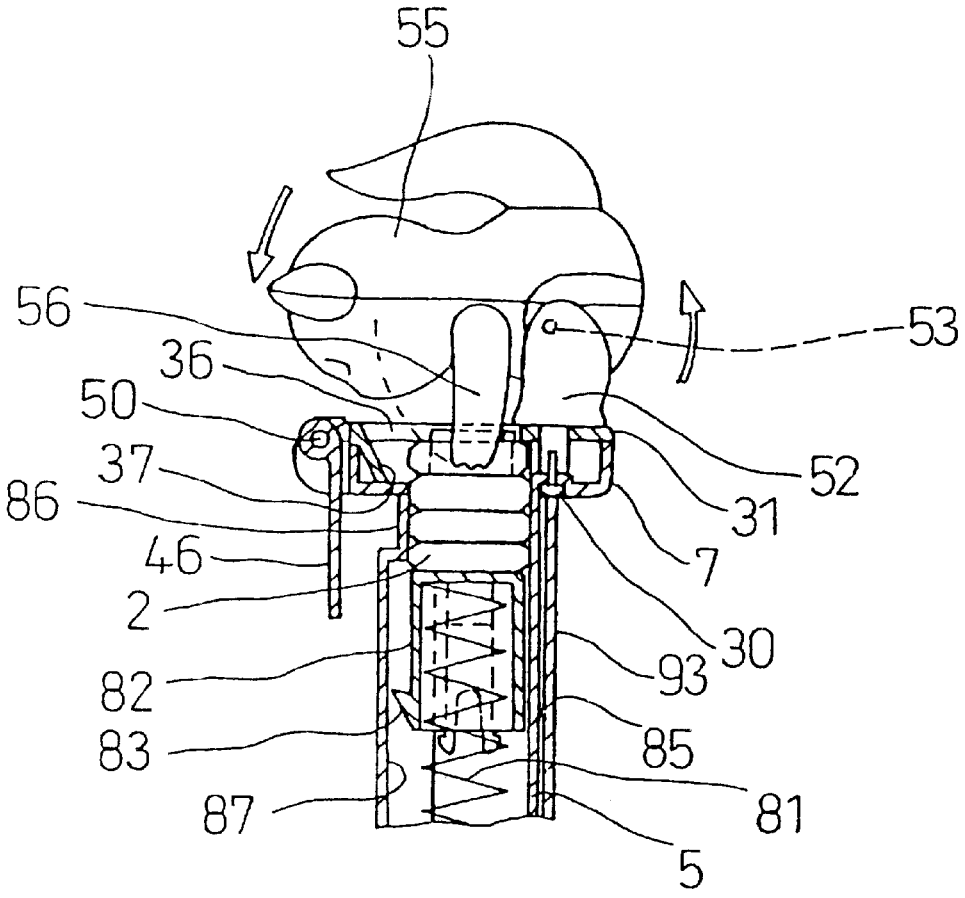
FIG. 5 is a fragmentary sectional view of a main part of FIG. 4.
Figure 6:
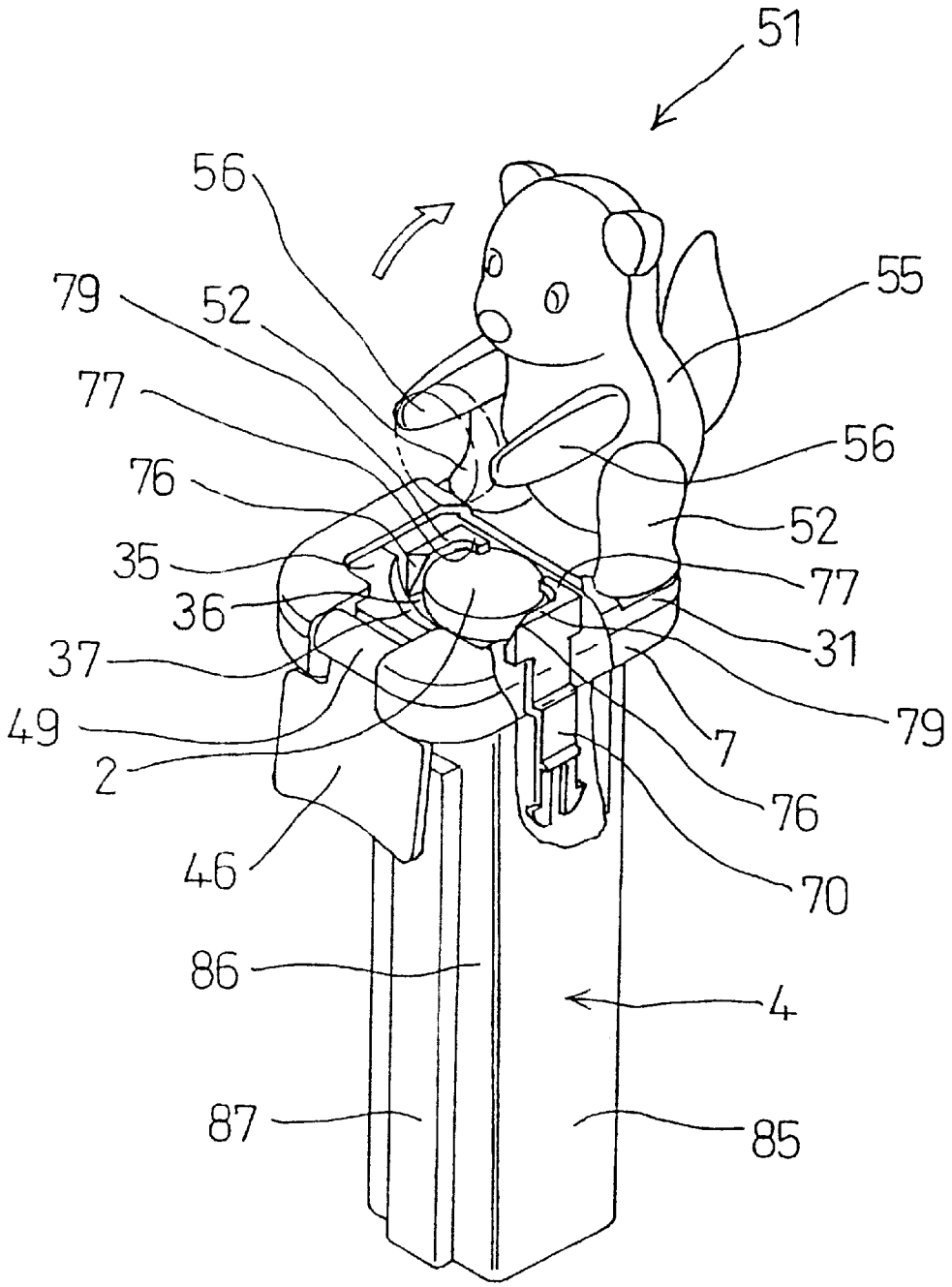
FIG. 6 is a perspective view showing the state in which an article is taken out.
Figure 7:
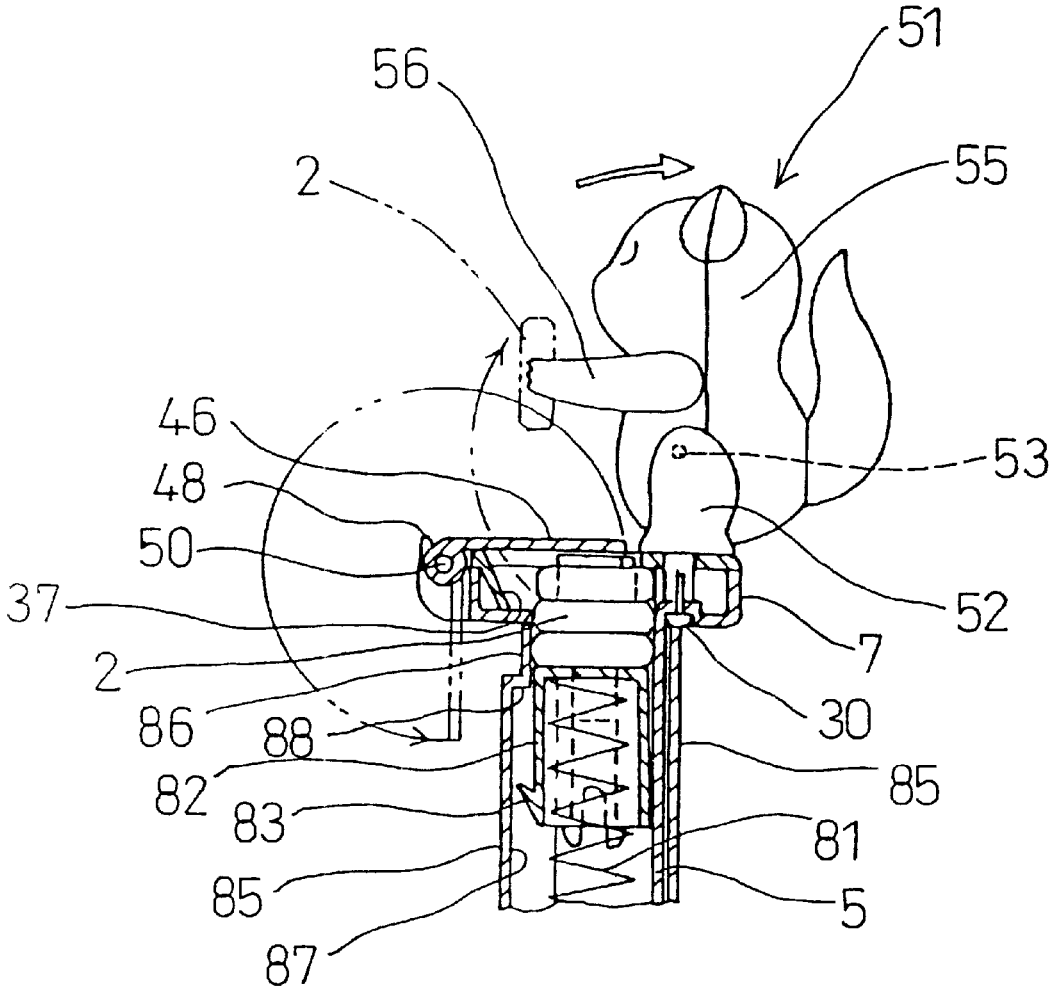
FIG. 7 is a fragmentary sectional view of a main part of FIG. 6.

When the plurality of articles 2 are stored in a vertical stack within the case body 4, although the plurality of articles 2 are biased toward the dispensing opening 36 by the elastic member 81, the plurality of articles 2 are prevented from jumping out from the dispensing opening 36 because both sides of the top article 2 among the plurality of articles 2 are engaged by the pair of engaging members 70 and 70 (see FIG. 6). In this state, when the rotating body 55 is rotated downward to the front direction as shown in FIGS. 4 and 5, the pair of holding pieces 56 and 56 hold both sides of the top article 2 while releasing the engagement by forcing open the pair of engaging members 70 and 70. Then, when the rotating body 55 is rotated upward to the back direction as shown in FIGS. 6 and 7, the pair of holding pieces 56 and 56 hold both sides of the top article 2, and can separate the article 2 from other articles 2 and take it out.

One embodiment in accordance. with the present invention is now further described with reference to the drawings. An article dispensing apparatus 1 comprises a case body 4 and a dispensing device 51. The case body 4 comprises a storing frame 3 for storing articles 2 such as lemon candies, chewing gum and marbles in a vertical stack, and a cover member 85 for storing the storing frame 3. The storing frame 3 consists of a sliding frame 5 with its front opening and a mounting frame 7 attached to the upper end of the sliding frame 5 and is molded integrally with synthetic resin. The sliding frame 5 is formed generally in the shape of a letter C with its front opening and comprises a left side plate 9, a right side plate 10, a rear plate 11 and a bottom plate 12. An engaging piece 13 is formed in the vicinity of the bottom plate 12.

The mounting frame 7 provided at the upper ends of the left side plate 9 and the right side plate 10 is formed with its upper part open and comprises a lower wall 15, a right wall 16, a rear wall 17, a left wall 19 and a front wall 20. An opening 18 communicating with an inside of the sliding frame 5 is formed in the lower wall 15. A bearing recess 21 generally in the shape of a letter C is formed in the front wall 20. Bearing walls 22 and 23 are formed in both sides of the bearing recess 21, and semicircular bearing recesses 24 and 25 are provided in the bearing walls 22 and 23.

A cover 31 is mounted to the opening of the mounting frame 7 by screws 30. The cover 31 is molded with synthetic resin and comprises an upper frame member 33 generally in the shape of a letter C with its front part 32 open and forms a dispensing opening 36 substantially in its center by the upper frame member 33 and the front wall 35. The front wall 35 provided in the front part of the dispensing opening 36 has a curved and inclining surface 37.

Bearing walls 39 and 40 are formed in the front part of the cover 31, and bearing recesses 41 and 42 in semicircular shape are provided in the bearing walls 39 and 40. When the cover 31 is attached to the mounting frame 7 by the screws 30, the bearing recesses 24 and 25 of the mounting frame 7 and the bearing recesses 41 and 42 of the cover 31 contact to form bearing holes 43 and 44. Supporting shafts 50 and 50 formed in the lower part of an open-close plate 46 are rotatably mounted in the bearing holes 43 and 44.

An arm member 47 is formed in the front part of the open-close plate 46, a boss 49 is provided in the top end of the arm member 47 and the supporting shafts 50 and 50 are protrudingly mounted to the both ends of the boss 49. The open-close plate 46 is formed in a shape to be fit in the upper frame member 33, and the arm member 47 is disposed between the bearing walls 39 and 40. The open-close plate 46 rotates with the supporting shafts 50 and 50 as its center, fits in the upper frame member 33 when touching the front wall 35 and closes the dispensing opening 36. Further, a hooking protrusion 48 for hooking a pawl is formed in the boss 49 for ease of opening the open-close plate 46.

A dispensing device 51 in an animal shape is provided in the cover 31. The dispensing device 51 comprises supporting members 52 and 52 in a leg shape fixed to the cover 31 by the screws 30 and 30, and a rotating body 55 in a body shape rotatably attached by supporting shafts 53 and 53 between the pair of supporting members 52 and 52. A pair of holding pieces 56 and 56 in an arm shape are provided in the rotating body 55.

Fixing frames 60 and 60 generally in the shape of the letter C in the cross-section are formed in the upper parts of the left side plate 9 and the right side plate 10 of the sliding frame 5. The fixing frames 60 and 60 are connected to the lower wall 15 of the mounting frame 7 in their upper ends, and inserting openings 61 and 61 formed in the lower wall 15 are formed to extend through to the inside of the fixing frames 60 and 60. Engaging edges 63 and 63 are formed in side walls 62 and 62 of the fixing frames 60 and 60 by openings 65 and 65. In addition, engaging stepped parts 67 and 67 are formed in the upper parts of the positions opposing the engaging edges 63 and 63 in the left side plate 9 and the right side plate 10.

Engaging members 70 and 70 are inserted from the inserting openings 61 and 61 are detachably attached to the fixing frames 60 and 60. The engaging member 70 is formed of an elastic material such as synthetic resin and has an inserting piece 71 in a flat shape to be inserted from the inserting opening 61. A pair of engaging pawls 72 and 72 to be engaged by engaging portions (not shown) of the fixing frame 60 are formed in the bottom edge of the inserting piece 71. An engaging protrusion 73 for engaging with the engaging edge 63 is protrudingly mounted in the lower part of the inserting piece 71. A bent stepped portion 75 for engaging with the engaging stepped portion 67 is formed substantially in the center of the inserting piece 71. An inclining surface 76 is formed in the upper part of the inserting piece 71 and a stopper piece 79 to which an engaging protrusion 77 is protrudingly mounted is provided in the rear part of the inserting piece 71.

A push-up member 82 attached to one end of a coil spring 81 and to be biased toward an opening 18 by the coil spring 81 is slidably provided in the sliding frame 5 in the vertical direction. The other end of the coil spring 81 is fixedly engaged in an engaging piece 13. A guiding protrusion 83 is formed in the front surface of the push-up member 82.

The sliding frame 5 is housed in a cover 85 generally in a rectangular shape. The cover 85 is molded with synthetic resin. A guiding groove 87 for guiding the guiding protrusion 83 of the push-up member 82 is formed in a front wall 86 of the cover 85. Supplemental cover portions 91 and 92 for covering the fixing frames 60 and 60 are formed in both side walls 89 and 90 of the cover 85. An engaging pawl 95 to be engaged in an engaging hole 14 formed in the lower wall 15 of the mounting frame 7 is formed in the upper part of a rear wall 93 of the cover 85.

Figure 2:
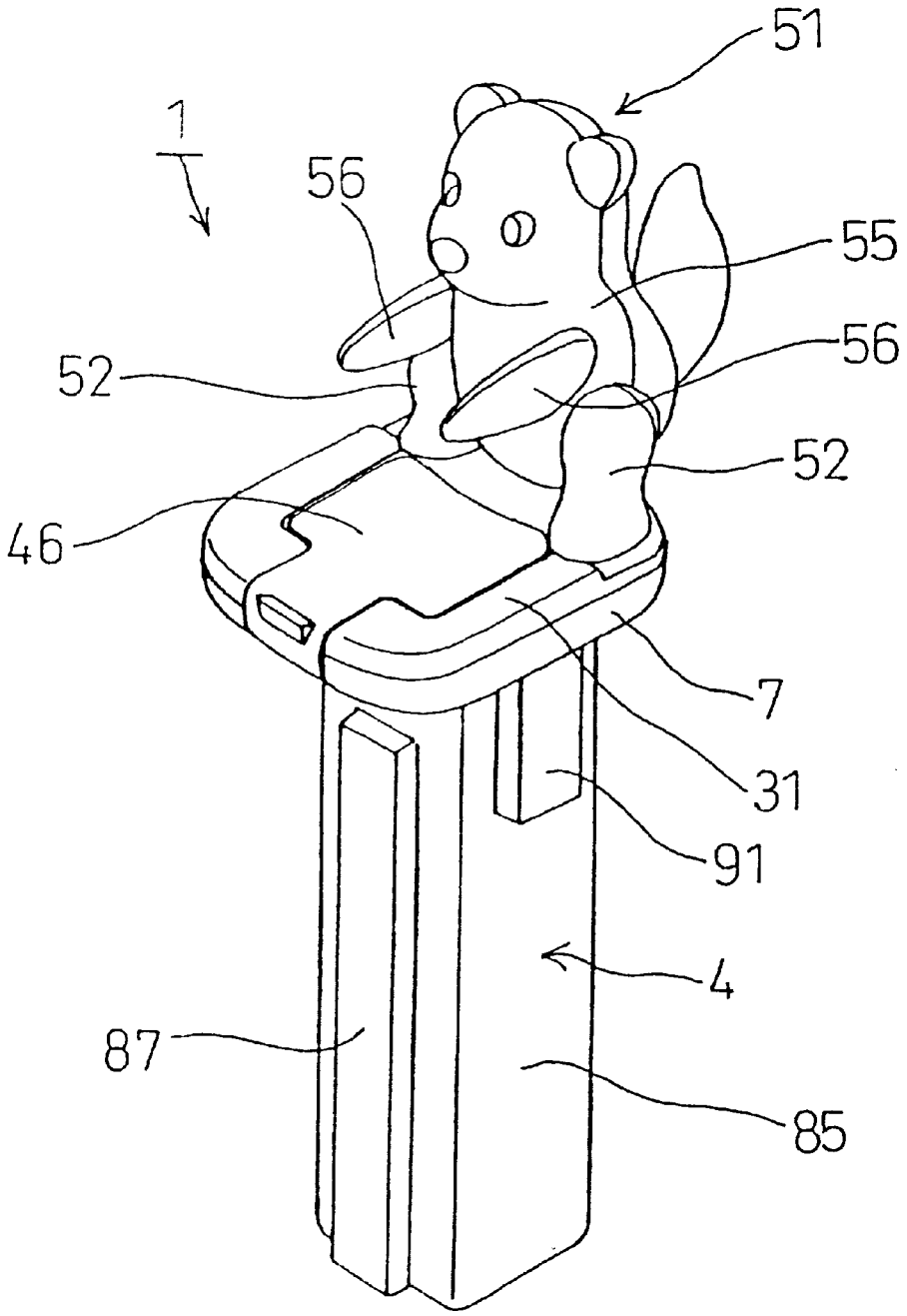
FIG. 2 is an assembled perspective view of FIG. 1.
Figure 3:
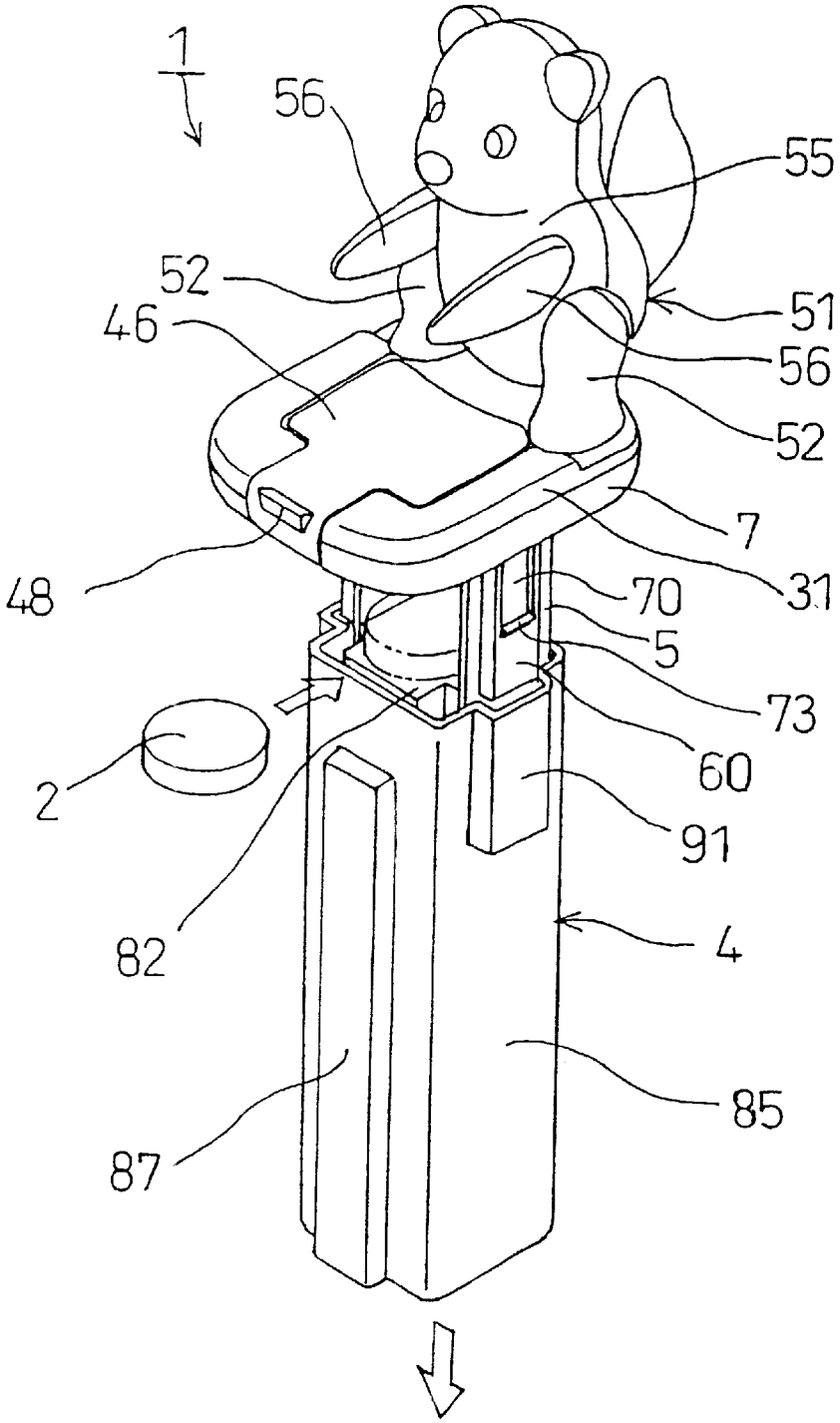
FIG. 3 is an assembled perspective view of FIG. 2 with a over slid.

In the article dispensing apparatus with the above-mentioned structure, whose ordinary state is shown in FIG. 2, when an engaging pawl 95 is detached from the engaging hole 14 of the mounting frame 7 and the cover 85 is slid downward as shown in FIG. 3, a top end 88 of the guiding groove 87 engages in the guiding protrusion 83 and pushes down the push-up member 82 against the elasticity of the coil spring 81.

When articles 2 are stored in stack in the vertical direction in the sliding frame 5 and the cover 85 is slid upward to engage the engaging pawl 95 in the engaging hole 14 of the mounting frame 7, a plurality of articles 2 are pushed upward by the push-up member 82 biased by the elasticity of the coil spring 81, and the top article 2 among the plurality of articles 2 is engaged in the engaging protrusions 77 and 77 of the engaging members 70 and 70 as shown in FIG. 7. The article 2 may also be stored from the dispensing opening 36.

When the dispensing opening 36 is opened by rotating the open-close plate 46 and the rotating body 55 is rotated forward as if it is fallen down, the pair of holding pieces 56 and 56 touch the inclining surfaces 76 and 76 of the engaging members 70 and 70 and rotate to hold the top article 2 while pushing open the stopper pieces 79 and 79 of the engaging members 70 and 70 against the elasticity of the material. When the pair of holding pieces 56 and 56 hold the top article 2, the stopper pieces 79 and 79 are fully opened and the engagement of the engaging protrusions 77 and 77 provided in the stopper pieces 79 and 79 relative to the article 2 is released.

When the rotating body 55 is rotated backward to be raised, the pair of holding pieces 56 and 56 hold the top article 2 and take it out of the storing frame 3 as shown in FIGS. 6 and 7. The article 2 second from the top is not pulled out together with the top article 2 even if the top article 2 is taken out because the article 2 second from the top touches the front wall 86 of the cover 85, and will become the top article 2 by being engaged by the engaging protrusions 77 and 77 of the engaging members 70 and 70, which have returned to their original position by the elasticity of the material.

Thus, when the rotating body 55 is rotated forward and then raised backward, the pair of holding pieces 56 and 56 lift and take out one of the articles 2. If the supporting members 52 and 52 are formed in the shape of animal legs, the rotating body 55 is formed in the shape of animal body and the pair of holding pieces 56 and 56 are formed in the shape of animal arms, the article dispensing apparatus 1 can take an action as if an animal toy lifts and takes out the article 2. In addition, if the rotating body 55 is biased backward by an elastic member such as a spring, it may not be necessary to raise the rotating body 55 backward manually because it is raised backward by the elastic restoration power of the elastic member, although it needs to be pressed down when it is rotated down forward.

As described above, the first aspect of the present invention has an effect that an article dispensing apparatus with a novel structure that could not conventionally be obtained that can lift and take out articles such as candies stored in stack in a case body one by one in an order from the top one can be provided. The article dispensing apparatus, unlike conventional ones that slide out the top article, employs an interesting motion in that it separates the top article from other articles to take it out as if it lifts out the article. If a rotating body for taking out the article is formed in the shape of an animal, the article dispensing apparatus can be extremely novel and unique because it makes motions as an animal toy when it lifts and takes out the article. Further, since the article is held and lifted, it may be a spherical article, such as a marble, without being limited to a flat article such as in the dispensing apparatuses of past.

Thus, it is seen that an article dispensing apparatus is provided. One skilled in the art will appreciate that the present invention can be practiced by other than the preferred embodiments which are presented for the purposes of illustration and not of limitation, and the present invention is limited only by the claims which follow:

What is claimed is:

1. An article dispensing apparatus, comprising:

a case body for storing articles in a vertical stack;

a dispensing opening formed in the upper part of the case body for taking out the stored articles one by one in an order from the top one, and an elastic member provided in the lower part of the case body for biasing the stored articles to the dispensing opening;

a pair of engaging members provided in the vicinity of the dispensing opening of the case body for engaging both sides of the top article among a plurality of articles biased by the elastic member to prevent a plurality of articles from being dispensed from the dispensing opening; and a dispensing device in a creature shape comprising a rotating body rotatably provided in the upper part of the case body, and a pair of holding pieces provided in the rotating body for holding the both sides of the top article among the plurality of articles while releasing the engagement of the pair of engaging members, wherein the case body comprises a storing frame for storing the articles in the vertical stack and a cover member for the storing frame, wherein the articles are candies, pieces of chewing gum or marbles, wherein the storing frame includes a sliding frame with a front opening and a mounting frame that is attached to the upper end of the sliding frame and is molded integrally with synthetic resin, wherein the sliding frame is formed generally in the shape of a letter C, wherein the sliding frame comprises a left side plate, a right side plate, a rear plate, and a bottom plate, and wherein an engaging piece is formed in the vicinity of the bottom plate.

2. The apparatus of claim 1, wherein the mounting frame is provided at the upper ends of the left side plate and the right side plate, wherein the mounting frame is formed with its upper part open and comprises a lower wall, a right wall, a rear wall, a left wall, and a front wall, wherein an opening communicating with an inside of the sliding frame is formed in the lower wall, wherein a bearing recess generally in the shape of a letter C is formed in the front wall, and wherein bearing walls are formed in both sides of the bearing recess and semi-circle bearing recesses are provided in the bearing walls.

3. The apparatus of claim 2, wherein a cover is mounted to the open upper part of the mounting frame by screws, wherein the cover is molded with synthetic resin and comprises an upper frame member generally in the shape of a letter C with its front part open and wherein the cover forms a dispensing opening substantially in its center by the upper frame member in the front wall, and wherein the front wall is provided in the front part of the dispensing opening and has a curved and inclining surface.

4. The apparatus of claim 3, wherein bearing walls are formed in a front part of the cover and bearing recesses in semi-circular shape are provided in the bearing walls, wherein the bearing recesses of the mounting frame and the bearing recesses of the cover contact to form bearing holes, and wherein supporting shafts formed in the lower part of an open-close plate are rotably mounted in the bearing holes.

5. The apparatus of claim 4, wherein an arm member is formed in the front part of the open-close plate, wherein a boss is provided in the top end of the arm member, wherein supporting shafts are protrudingly mounted to both ends of the boss, wherein the open-close plate is formed in a shape to fit in the upper frame member, wherein the arm member is disposed between the bearing walls, wherein the open-close plate rotates with the supporting shafts as its center, fits in the upper frame member when touching the front wall and closes the dispensing opening, and wherein a hooking protrusion for hooking a pawl is formed in the boss.

6. The apparatus of claim 5, wherein the dispensing device in a creature shape is provided in the cover, wherein the dispensing device comprises supporting members in a leg shape fixed to the cover by screws and a rotating body in a body shape rotably attached by supporting shafts between the pair of supporting members, and wherein a pair of holding pieces in an arm shape are provided in the rotating body.

7. The apparatus of claim 6, wherein fixing frames generally in the shape of the letter C in the cross-section are formed in the upper parts of the left side plate and the right side plate of the sliding frame, wherein the fixing frames are connected to the lower wall of the mounting frame in their upper ends and wherein inserting openings formed in the lower wall are formed to extend through to the inside of the fixing frames, wherein extending edges are formed in side walls of the fixing frames by the openings, and wherein engaging stepped parts are formed in the upper parts of the positions opposing the engaging edges in the left side plate and the right side plate.

8. The apparatus of claim 7, wherein engaging members are inserted from the inserting openings and are detachably attached to the fixing frames, wherein the engaging members are formed of an elastic material and have an inserting piece in a flat shape to be inserted from the inserting opening, wherein a pair of engaging pawls to be engaged by engaging portions of the fixing frame are formed in the bottom edge of the inserting piece, wherein an engaging protrusion for engaging with the engaging edge is protrudingly mounted in the lower part of the inserting piece, wherein a bent stepped portion for engaging with the engaging stepped portion is formed substantially in the center of the inserting piece, and wherein an inclining surface is formed in the upper part of the inserting piece and a stopper piece to which an engaging protrusion is protrudingly mounted is provided in the rear part of the inserting piece.

9. The apparatus of claim 8, wherein a push-up member attached to one end of a coil spring and biased toward an opening by the coil spring is slidably provided in the sliding frame in the vertical direction, wherein the other end of the coil spring is fixedly engaged in an engaging piece, and wherein a guiding protrusion is formed in a front surface of the push-up member.

10. The apparatus of claim 9, wherein the sliding frame is housed in a substantially rectangular cover, wherein the cover is integrally formed of synthetic resin, wherein a guiding groove for guiding the guiding protrusion of the push-up member is formed in a front wall of the cover, wherein supplemental cover portions for covering the fixing frames are formed in both side walls of the cover, and wherein an engaging pawl to be engaged in an engaging hole formed in the lower wall of the mounting frame is formed in the upper part of a rear wall of the cover.

11. The apparatus of claim 10, wherein the supporting members are formed in the shape of creature legs, the rotating body is formed in the shape of creature body and the pair of holding pieces are formed in the shape of creature arms.

12. The apparatus of claim 11, wherein the rotating body is biased backward by an elastic member and is raised backward by the elastic restoration power of the elastic member, and wherein the elastic member is a spring.

13. An article dispensing apparatus, comprising:

a case body comprising a storage frame that defines a storage space that receives the articles in a stacked relation, the storage frame having an open top end and including a sliding frame with a front opening and a mounting frame attached to the upper end of the sliding frame, the mounting frame including a cover that is structured to open and to close the open top end;

an elastic member provided in a lower part of the case body for biasing the stored articles to the open top end; and a dispensing device disposed on top of the mounting frame, the dispensing device including a rotating body rotatably provided in an upper part of the case body, the rotating body including a pair of holding pieces, the holding pieces being structured to hold sides of the top article among the plurality of articles, wherein the article dispensing apparatus is structured to move the cover to open the open top end before rotating the holding pieces to hold the sides of the top article.

14. The apparatus of claim 13, wherein the article dispensing apparatus forms a creature shape.

15. The apparatus of claim 14, wherein the holding pieces form appendages of the creature shape.

16. The apparatus of claim 13, wherein the sliding frame includes a left side plate, a right side plate and a bottom plate.

17. The apparatus of claim 16, wherein the mounting frame is disposed at upper ends of the left side plate and the right side plate, and wherein the mounting frame includes a lower wall in which is formed an opening that communicates with an inside of the sliding frame.

18. The apparatus of claim 13, wherein the mounting frame is molded with synthetic resin, and wherein the mounting frame includes a front wall disposed in a front part of the open top end, the front wall having a curved and inclining surface.

19. The apparatus of claim 13, further comprising:

a pair of engaging members, disposed in the vicinity of the open top end, that engage sides of the top article among the plurality of articles biased by the elastic member.

20. The apparatus of claim 13, wherein the dispensing device includes supporting members, and wherein the rotating body is rotatably attached by supporting shafts between the supporting members.

21. The apparatus of claim 13, wherein a push-up member attached to one end of a coil spring and biased toward an opening by the coil spring is slidably provided in the sliding frame in the vertical direction, wherein the other end of the coil spring is fixedly engaged in an engaging piece, and wherein a guiding protrusion is formed in a front surface of the push-up member.

22. The apparatus of claim 13, wherein the sliding frame is housed in a substantially rectangular housing, wherein the housing is integrally formed of synthetic resin, and wherein a guiding groove for guiding a guiding protrusion of a push-up member is formed in a front wall of the housing.

23. The apparatus of claim 13, wherein the rotating body is formed in a shape of a creature body, and wherein the pair of holding pieces are formed in a shape of creature arms.

24. The apparatus of claim 13, wherein the rotating body is biased backward by a second elastic member and is raised backward by elastic restoration power of the second elastic member.

25. The apparatus of claim 24, wherein the second elastic member is a spring.

26. The apparatus of claim 13, wherein the articles are candies, pieces of chewing gum or marbles.

27. The apparatus of claim 13, wherein the case body stores the articles in a vertical stack.

28. The apparatus of claim 13, wherein the sliding frame has a cross section that forms generally a C-shape.

29. The apparatus of claim 13, wherein the mounting frame is molded integrally to an upper end of the sliding frame with synthetic resin.

* * * * *

UNITED STATES PATENT AND TRADEMARK OFFICE

CERTIFICATE OF CORRECTION

PATENT NO. : 6,425,495 B1 
DATED : July 30, 2002
INVENTOR(S) : Junji Senda and Yoshimi Miyamoto It is certified that error appears in the above-identified patent and that said Letters Patent is hereby corrected as shown below:

Title page,
Item [63], Related U.S. Application Data, change "November 1, 1996" to
-- November 1, 1999 --

Signed and Sealed this

Tenth Day of June, 2003

JAMES E. ROGAN
*Director of the United States Patent and Trademark Office*